US007828573B2

(12) United States Patent
Butaud

(10) Patent No.: US 7,828,573 B2
(45) Date of Patent: Nov. 9, 2010

(54) SUBSEA ELECTRICAL CONNECTOR AND METHOD

(75) Inventor: Wade R Butaud, Pasadena, TX (US)

(73) Assignee: S&N Pump Company, Houston, TX (US)

( * ) Notice: Subject to any disclaimer, the term of this patent is extended or adjusted under 35 U.S.C. 154(b) by 120 days.

(21) Appl. No.: 12/259,759

(22) Filed: Oct. 28, 2008

(65) Prior Publication Data

US 2010/0105233 A1 Apr. 29, 2010

(51) Int. Cl.
*H01R 13/62* (2006.01)

(52) U.S. Cl. ..... 439/310; 439/278

(58) Field of Classification Search ..... 439/310–314, 439/278, 281, 732, 362
See application file for complete search history.

(56) References Cited

U.S. PATENT DOCUMENTS 3,491,326 A 1/1970 Pfister et al.
3,641,479 A 2/1972 O'Brien et al.
3,729,699 A 4/1973 Briggs et al.
3,845,450 A 10/1974 Cole et al.
3,945,701 A * 3/1976 Boeke et al. ..... 439/281
4,540,230 A 9/1985 Iversen et al.
4,859,196 A 8/1989 Durando et al.
5,038,563 A 8/1991 McMahan et al.
5,120,268 A * 6/1992 Gerrans ..... 439/736
5,474,465 A * 12/1995 Kobayashi ..... 439/278
5,801,465 A 9/1998 Yamada
2006/0245958 A1 11/2006 Carter

FOREIGN PATENT DOCUMENTS

GB 2138223 10/1984

* cited by examiner

*Primary Examiner*—Tho D Ta
*Assistant Examiner*—Travis Chambers
(74) *Attorney, Agent, or Firm*—Kenneth L. Nash

(57) ABSTRACT

A subsea electrical connector for connecting a first cable and a second cable. A first insulator has an outer face, possibly an inner face, and a pin portion transverse to the outer face. A second insulator has a mating outer face, an inner face, and a pin receptacle. At least one face seal ring is positioned between the first insulator outer face and the second insulator outer face. At least one pin seal ring is positioned between the pin portion and the pin receptacle. Preferably, an interference fit is provided between the pin and pin receptacle. A preferred seating angle seal has an angled surface adjacent the end of the pin portion and within the pin receptacle. First and second electrical connectors are mounted within the first insulator and the second insulator. The first and second metal electrical connectors each have a socket for receiving the first and second cables. A preferred embodiment includes receptacles for the fasteners with stop members, which limit the relative rotation to align the fasteners with the receptacles.

19 Claims, 4 Drawing Sheets

SUBSEA ELECTRICAL CONNECTOR AND METHOD

BACKGROUND OF THE INVENTION

1. Field of the Invention

The present invention relates generally to the field of electrical connectors and, more specifically, relates to a subsea electrical connector and method.

2. Description of the Background

Although subsea electrical connectors have been utilized for years, under certain conditions prior art subsea connectors have been found to fail with an undesirably high frequency. This is especially true when subsea connectors are utilized under conditions where they and the cables they connect are subject to underwater currents, which may occur in certain offshore drilling rig applications. The typically significant weight of the electrical cables, and the forces/tensions produced due to exposure to underwater currents are believed to greatly increase the likelihood of failure.

While completely eliminating subsea connectors is often considered the best solution to the problem of subsea electrical connector failures by those of skill in the art, this practice does not necessarily eliminate failures. For example, salt water introduced at one point in a cable may travel through the cable and eventually cause a failure.

Moreover, some applications limit the practical ability to avoid subsea connectors. In other words, it is simply not practical to eliminate all subsea electrical connectors for some applications. For instance, in applications for subsea pumps, the size of wire reels and the size of subsea electrical motors make installation and transportation very difficult without the use of a subsea electrical connector. However, for these applications, subsea electrical connectors may be exposed and repeatedly stressed due to motion caused by ocean currents. While it has been known that prior art subsea connectors may short out under such conditions, solutions to the problem by those of skill in the art have not previously been successful.

Consequently, there remains a long felt need for an improved subsea connector and methods form making the same. The present invention provides a subsea electrical connector that can resolve seal issues, reduce leakage through the cable, relieve transportation and installation issues, and increase continuity and performance of the electrical connection. Because those skilled in the art have recognized and attempted to solve these problems in the past without reliable success, they will appreciate the present invention, which addresses these and other problems.

SUMMARY OF THE INVENTION

An object of the invention is to provide an improved subsea electrical connector.

Another possible object of the invention is to provide an electrical connection that is leak proof under severe weather conditions.

Another possible object of the invention is to provide a subsea electrical connector that does not fail even if the associated cables and the connector are exposed to ocean currents in salt water, whereupon the cable is stressed to a high degree.

A further possible object of the invention is to provide an electrical connection that avoids failure due to prolonged exposure to salt water.

Yet another possible object of the invention is to provide an electrical connection that is useful for submersible seawater pump motors or submersible motor applications generally.

Yet another possible object of the invention is to provide an electrical connection with automatic alignment of male and female interlocking electrical connectors to avoid improper makeup.

Another possible object of the invention is to provide an electrical connector that can be connected and disconnected, at least occasionally, to avoid the need for simultaneously handling a large reel of cable and/or a heavy motor for installation and transportation.

Another possible object of the invention is to provide an electrical connector with molded seals of different types and special internal surfaces.

These and other objects, features, and advantages of the present invention will become apparent from the drawings, the descriptions given herein, and the appended claims. However, it will be understood that the above-listed objectives and/or advantages of the invention are intended only as an aid in quickly understanding aspects of the invention, are not intended to limit the invention in any way, and therefore do not form a comprehensive or restrictive list of objectives, and/or features, and/or advantages.

In accordance with a preferred embodiment of the invention, there is disclosed a subsea electrical connector for connecting a first cable and a second cable. In one possible embodiment, the invention may comprise a first insulator with a first insulator outer face. A second insulator may be provided with an outer face. A face seal ring may be utilized between the first insulator outer face and the second insulator outer face. One possible embodiment may comprise outer face seal ring(s) being molded to one of the first insulator or the second insulator. Bolts may be utilized to secure the face seal together.

A pin/receptacle seal portion of the connector may be perpendicular or transverse to the outer face seal. The pin/receptacle seal may comprise one or more seals positioned thereon, which may be molded seals. The pin/receptacle seal portion may also utilize an interference fit to provide yet another seal along the length of the pin/receptacle seal portion, which may seal between the preferably molded seals.

An interior seating angle seal may be utilized which may comprise an angled surface on the pin portion and an angled mating surface within the pin receptacle, which is sealingly activated as the bolts are tightened. In one possible embodiment, the angled surface of the pin portion may be the same as the angled surface of the pin receptacle. If desired, at the end of the pin, a pin face seal may be formed whereupon a pin receptacle end surface engages the pin face.

In one possible embodiment, first and second metal electrical connectors may be mounted within the first insulator and the second insulator. The first and second metal electrical connectors each comprise a socket for receiving the first and second cables. Rotation stop members may, in one possible embodiment, limit the relative rotation between the first insulator and the second insulator to align bolt holes in the connector sections.

In accordance with a possible embodiment of the invention, there is disclosed a method for making a subsea electrical connector for connecting a first cable and a second cable that may comprise forming/molding/providing a first insulator comprised of a first insulator outer face, inner face, and a pin or male portion. Another step may comprise forming/molding/providing a second insulator with an outer face, an inner face, and a socket or female receptacle.

The method may comprise mounting/molding the first and second metal electrical connectors within the first and second insulators. An additional possible step may provide that the first and second metal electrical connectors each comprise a socket for receiving the first and second cables. One possible method may comprise providing rotation stop members to limit relative rotation between the first and second insulator.

In another embodiment, the method may comprise providing a face seal ring between the first insulator outer face and the second insulator outer face. A further possible step may comprise providing at least one pin/receptacle seal ring with interference fit between the pin and the socket.

The method may comprise forming a seating angle seal with an angled surface on the pin portion and an angled mating surface within the socket. Another step may comprise forming a pin face seal on an end of the pin portion. A further possible step may comprise forming a mating socket surface to sealingly engage a pin face seal surface.

In accordance with another possible embodiment of the invention, there is disclosed a subsea electrical connector for connecting a first cable and a second cable that may be comprised of a first insulator comprised with an outer face, an inner face, and a pin portion. A second insulator may comprise an outer face, an inner face, and a pin receptacle. A face seal ring may be positioned, mounted, or preferably molded between the first insulator outer face and the second insulator outer face. In one possible embodiment, at least one pin seal ring with interference fit may be provided between the pin portion and the pin receptacle.

A seating angle type seal may comprise an angled surface on the pin portion and an angled surface within the pin receptacle. The angled surface of the pin portion may or may not comprise a different angle than the angled surface of the pin receptacle.

Another possible embodiment may comprise having the first and second metal electrical connectors mounted within the first insulator and second insulator. The first and second metal electrical connectors each may comprise a socket for receiving the first and second cables. The first and second electrical insulators may be sized such that when the first insulator outer face engages the second insulator outer face. The first and second electrical connectors may comprise a clearance therebetween to allow the first insulator outer face and the second insulator outer face and/or other seals to compress when tightening the fasteners, such as bolts. Another possible embodiment may comprise a plurality of fasteners, the first insulator and the second insulator may define receptacles for the fasteners.

A metal member or members may be positioned in the first insulator or second insulator. Further, a possible embodiment may comprise the metal member being a ring that may be molded into one or more insulators. The metal ring defines openings, which are aligned with the fastener holes.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION OF PRESENTLY PREFERRED EMBODIMENTS

Figure 1A:
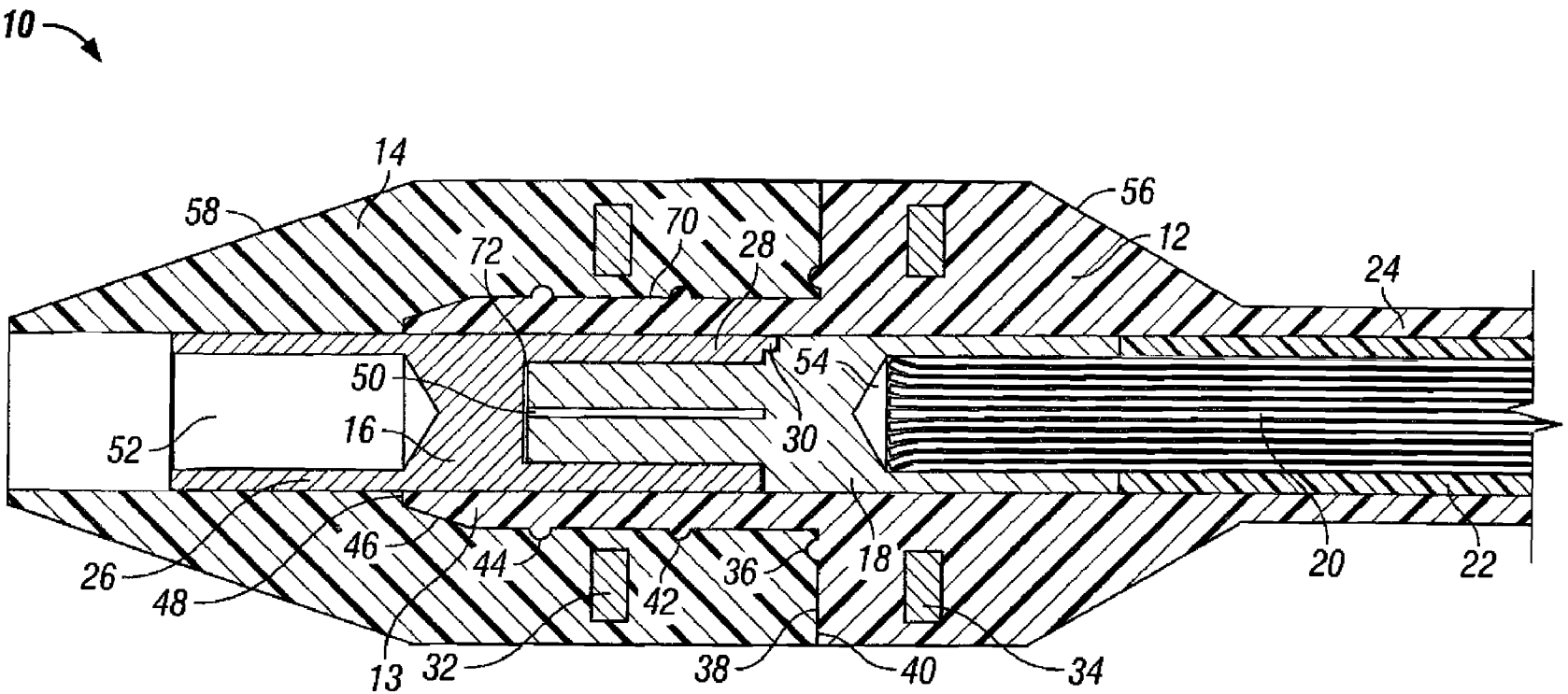
FIG. 1A is an elevational view, in cross section, which shows a subsea electrical connector in accord with one possible embodiment of the present invention.
Figure 1B:
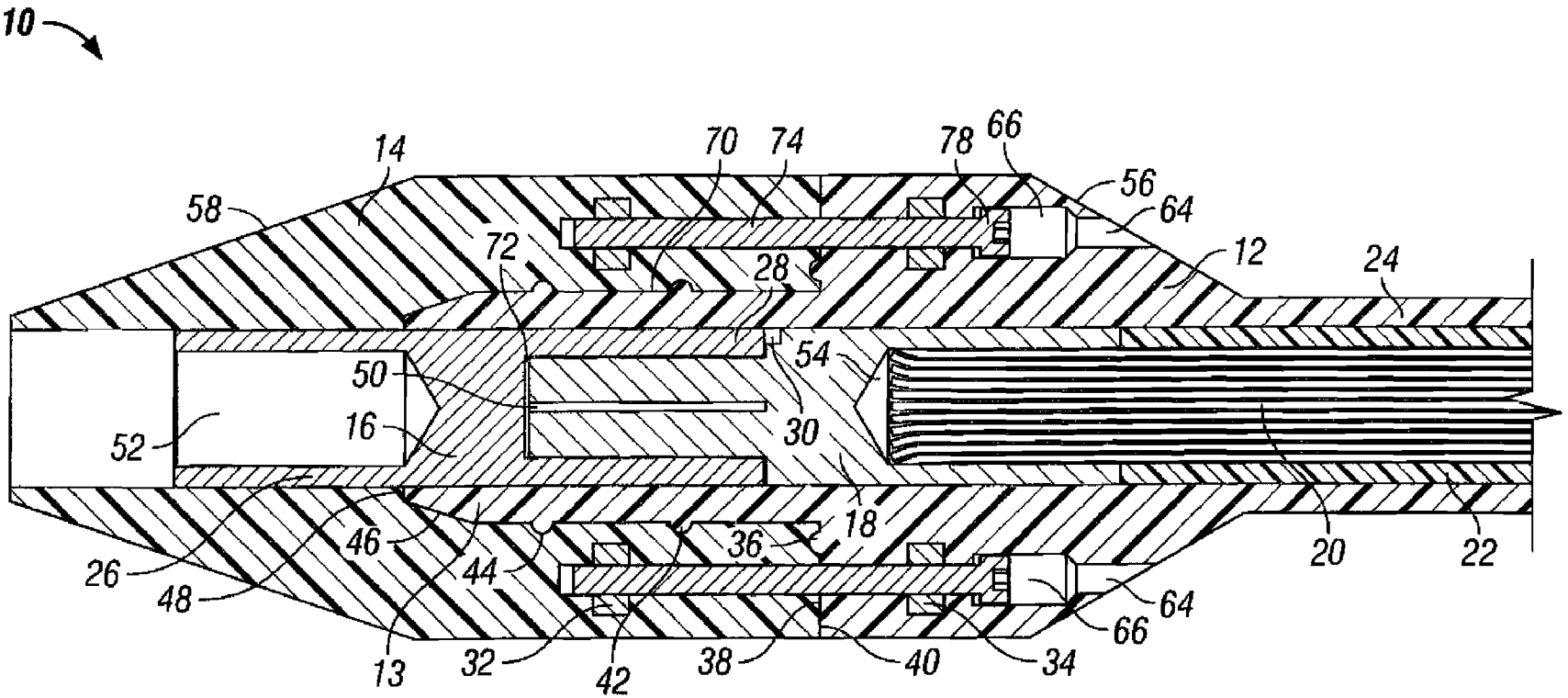
FIG. 1B is an elevational view, in cross section, which shows a rotated view of the electrical connector of FIG. 1A in accord with one possible embodiment of the present invention.

Now referring to the drawings, and more particularly to FIG. 1A and FIG. 1B, there is shown one possible embodiment of a subsea electrical connector 10. Electrical connector 10 may comprise a first insulator 12, which may comprise a male or pin portion 13 (see FIG. 2). Electrical connector 10 may also include a second insulator 14, which may be referred to as a female or socket portion. First insulator section 12 and second insulator section 14 fit together as discussed below to provide a reliable, quickly securable electrical connector that can withstand severe weather conditions including underwater currents. First and second insulators 12 and 14 may comprise cylindrical and conical portions as illustrated.

While the present invention shows only two insulator sections 12 and 14, additional sections may also be used. For example, insulator 14 may comprise one or more parts and insulator 12 may comprise one or more parts.

In another embodiment, insulator 12 and the various subcomponents discussed hereinafter including cable 22 may be molded together in a one-piece construction. Likewise, insulator 14 and associated components may be molded in a one-piece construction with a corresponding cable.

Figure 3:
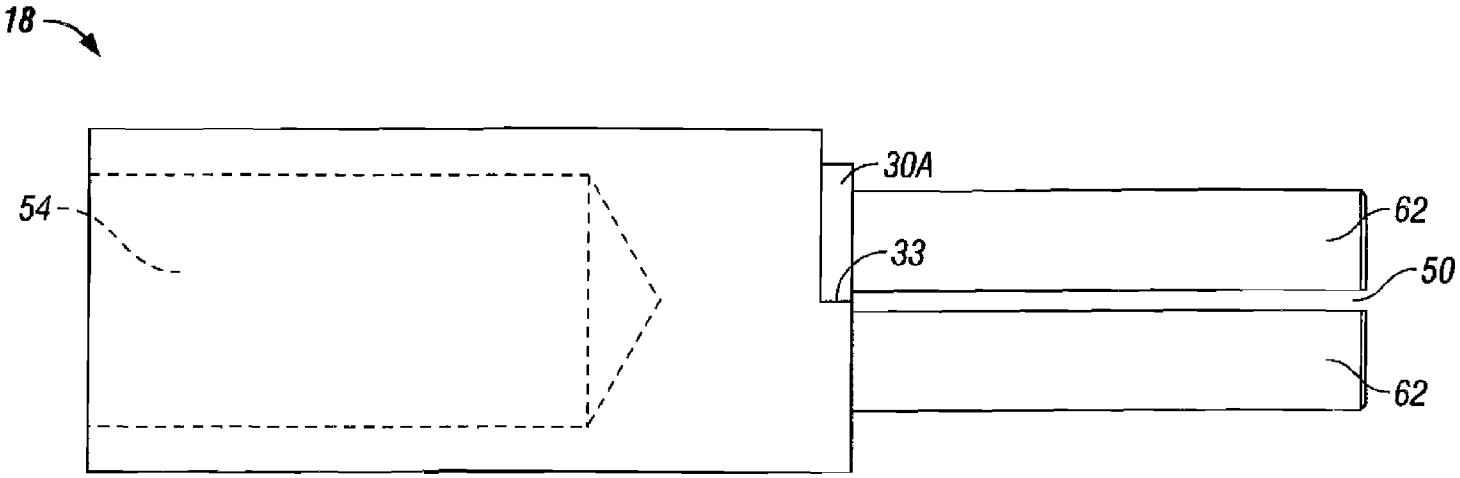
FIG. 3 is an elevational view, partially in dashed lines, which shows an enlarged view of a male metal connector from FIG. 1A in accord with one possible embodiment of the present invention.
Figure 4:
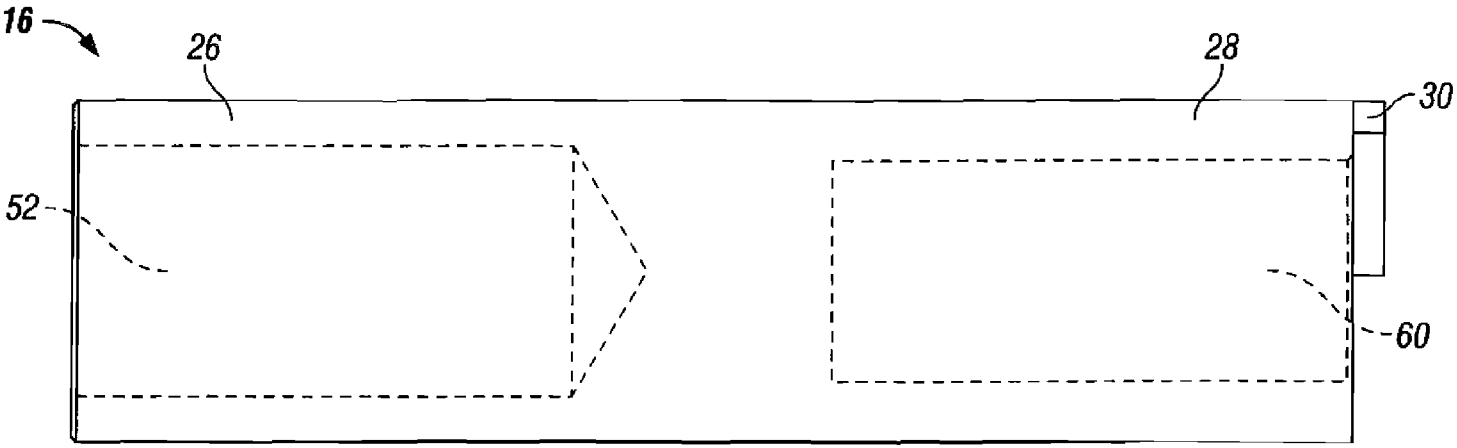
FIG. 4 is an elevational view, partially in dashed lines, which shows an enlarged view of a female metal connector from FIG. 1A in accord with one possible embodiment of the present invention.

Insulators 12 and 14 may comprise a first metal electrical connector 18 and a second metal electrical connector 16, respectively (see FIG. 3 and FIG. 4). The first and second metal electrical connectors may be comprised of any conductive material which has low resistance to the electric power to be carried through the connector. In one embodiment, brass may be utilized in the electrical connectors 16 and 18. Other suitable metals may also be utilized. As noted above, the electrical connectors may be molded into the respective insulators. The shape, mounting, and/or arrangements of the metal electrical conductors may vary so long as they comply with the constraints of the connection requirements. Some possible variations are discussed hereinafter.

First insulator 12 may include an end section 24 through which cable 20 extends. Second insulator 14 connects in a similar way to another section of electrical cable. Electrical cable 20 may be soldered/welded/clamped/and/or otherwise securely fastened within socket 54 defined within electrical connector 18. As one example of construction, insulator 12 may be molded around a length of cable whereby end section 24 may be formed during molding. Thus, in one embodiment, the respective insulators become essentially one-piece with insulation 22 of the respective cables. In another embodiment, insulator 12 and internal components may be molded together and an outer covering may be molded around the construction to secure the assembly to the cable. The molding between cable insulation 22 and insulator 12 seals the opening in end section 24 through which the cable is inserted. The same seal around the cable is made for insulator 14. Other construction methods may also be utilized to secure the electrical connectors to the insulators.

As one example of a first possible metal electrical connector 16, which may be configured as a female connector, sockets may be formed on each end, as perhaps is more easily seen in FIG. 4. For example, end 26 may define opening 52 for receiving another section of cable to be connected to the section of electrical cable 20. End 28 of first metal electrical connector 16 may define another opening 60 for receiving split pin 62 of male metal electrical connector 18 (see FIG. 3). As discussed above, the other electrical cable 20 is fastened into socket 54 of electrical connector 18. The outer surfaces of metal electrical connectors 16 and 18 may be grooved or have retainer members or elements to further ensure bonding/molding to the respective insulators 12 and 14.

In one embodiment, pin 62 (see FIG. 3) may comprise one or more splits 50 whereby the ends of pin 62 may be expanded somewhat so that when inserted into opening 60, the metal-to-metal electrical connection surface contact area is maximized and the electrical resistance is made as small as is possible. The pin/socket may also be an alloy, coated, and/or otherwise treated if desired to keep the electrical resistance of the connection as low as possible.

Referring to FIG. 1B, fasteners 74 may be inserted into respective bolt holes or fastener openings 76 (see FIG. 2) for securing insulator 12 and insulator 14 together. In one possible embodiment, fasteners 74 may comprise 5-40 UNC× 1.75 inch bolts with No. 5 socket heads. However, bolts, studs, and/or other fasteners of various sizes may be utilized. Openings 76 in insulator 12 and insulator 14 must be aligned properly for use of fasteners 74 in assembling the connector sections together, which in one embodiment may be accomplished with rotation stop members as discussed below.

An opening 64 along the angled portion in the base end of the insulator 12 may be utilized for allowing tools, such as screwdrivers, socket drivers, and the like, to tighten any fasteners, such as screws, bolts or the like. In one embodiment, fastener head 78 (see FIG. 1B) fits into an expanded head region 66, which allows axial movement of head 78 during connection. Head region 66 insures that fasteners 74 are moveable but do not fall out or are removed inadvertently due to containment by the smaller diameter of opening 64, which may be smaller than the diameter of fastener head 78. Because insulator 12 may be somewhat elastic, fastener 74 and head 78 may be pushed through the smaller diameter of opening 64 prior to assembly.

Figure 2:
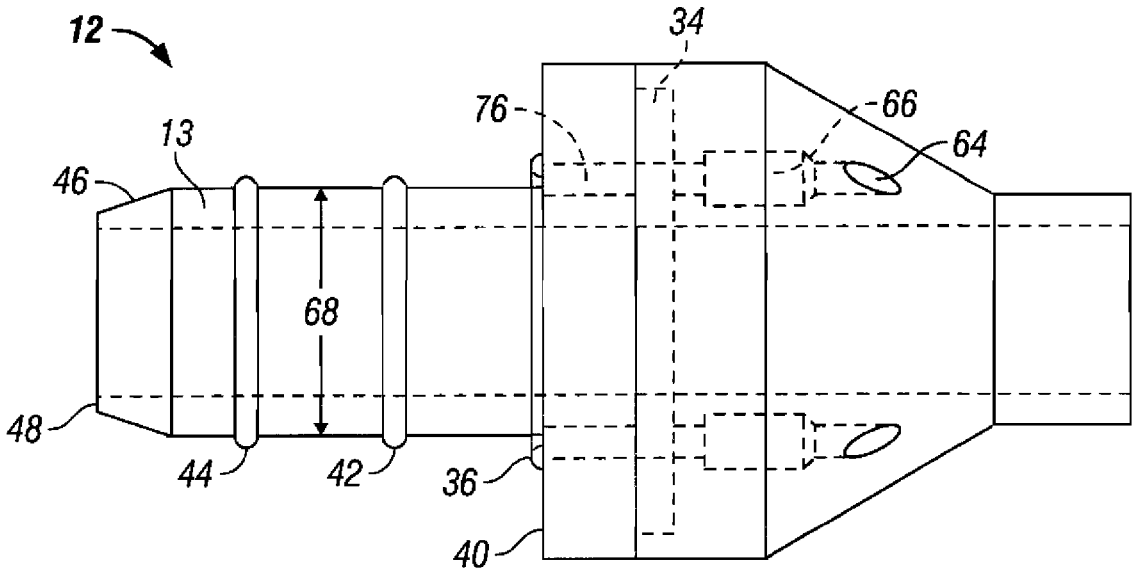
FIG. 2 is an elevational view, partially in dashed lines, which shows a pin portion of a submersible sea electrical connector in accord with one possible embodiment of the present invention.

An additional possible feature of connector 10 may comprise rotation stop or alignment members (see FIG. 3 and FIG. 4), which are utilized to align fastener openings 76 (see FIG. 2). Rotational contact between the metal contact members pin 62 and socket 60 during make-up of the connector also improves or lowers the 10 resistance of the connector, as discussed above. However, stop or alignment members may be constructed as desired and may simply align without rotation, if desired. Accordingly, stop members for alignment may be otherwise positioned, or be of different construction. In one embodiment, stop member 30 may be position on first metal electrical connector 16 for limiting relative rotation to allow proper alignment when engaging insulator 12 and insulator 14. Stop member 30 interacts with mating stop member 30A to provide rotational alignment. For example, the end of stop member 30 may rotate until it engages shoulder 33. However, other stop surface configurations, guide members, and the like, may also be utilized. Once the stop members are engaged to prevent further rotation, then bolt holes 76 are aligned.

To provide additional strength generally and to provide additional strength for the fasteners 74, one or more rings, such as metal rings 32 and 34, or other suitable metal members, may be utilized (See FIG. 1B). If desired, metal rings 32 and 34 may be molded into insulator 14 and 12, respectively, in a possible embodiment in accord with electrical connector 10. For example, metal rings 32 and 34 may comprise steel or other materials. Rings 32 and 34 may comprise holes aligned in accord with the bolt pattern for fasteners 74. In one embodiment, four equally spaced bolts may be utilized. Ring 32 may comprise threads within the holes formed therein which mate to threads on fasteners 74, if desired. Thus, as fasteners 74 are rotated, they tighten insulator 12 and insulator 14 together.

Figure 2A:
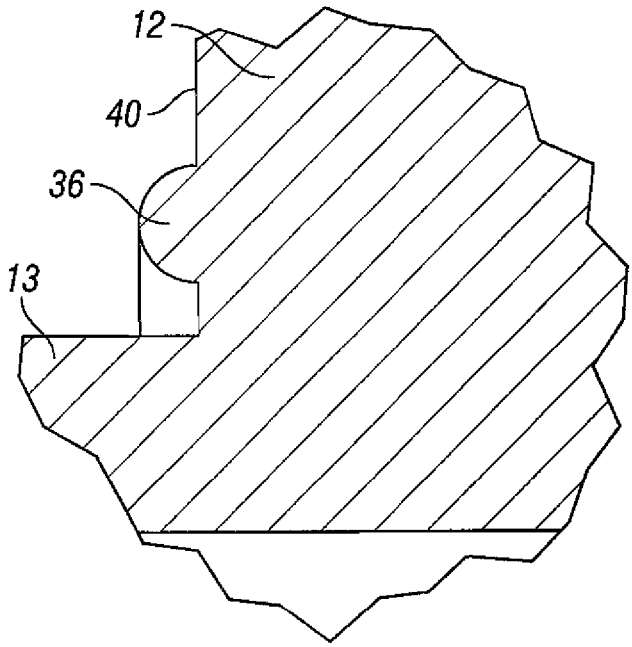
FIG. 2A is a cross sectional view, which shows an enlarged view of a face seal ring shown in FIG. 2 in accord with one possible embodiment of the present invention.

Referring to FIG. 2, and enlarged FIG. 2A, the present invention, in one preferred embodiment, includes an outer face seal ring 36 on first insulator 12, positioned on an outer face surface 40 of insulator 12. This outer face seal ring 36 acts as an O-ring seal and may mate to a corresponding notch or sealing surface on outer face surface 38 of insulator 14. It will be appreciated that the seal ring may be positioned on either surface 40 or 38 (See FIG. 1A). In other words, the seal ring and/or receptacle, if utilized, may be positioned on either outer face surface 38. As the fasteners are tightened, this seal is activated. Additional face seal rings may be utilized, if desired.

Referring to FIG. 2, in one preferred embodiment, seal ring 36 is molded onto outer face surface 40 and is not a separate O-ring. It is believed that a molded seal ring is superior to that of an O-ring for the present application, and is less likely to be made up improperly. A sealed O-ring also has less surface area that might leak than a typical O-ring. Installation is easier and avoids the real possibility of inadvertently missing O-rings.

A further embodiment, may utilize one or more pin seal rings, such as pin seal rings 42 and 44, which are preferably molded as part of insulator 12 on pin 13. Molding of seal rings 42 and 44 reduces risk of damage to the seal rings as they are inserted into pin receptacle or socket 70 of insulator 14 as compared to replaceable O-rings, especially if a tight interference fit is utilized as discussed hereinafter. Fewer than or more than two seal rings may be utilized. While the cross-sectional view of pin 13 is shown as being substantially straight, the cross-section pin 13 might be conical, rounded, or the like, if desired. Pin 13 is generally transverse to or at a right angle to face 40.

In one preferred embodiment, an interference fit is provided between pin 13 and receptacle 70. In other words, outer diameter 68 (see FIG. 2) other than at seals 42 and 44 is preferably greater than the corresponding inner diameter of receptacle 70. Because these components are preferably rubber or plastic, they will stretch/compress to form a very tight seal.

Seals 42 and 44 may comprise an interference fit into receptacle 70 even without the interference fit between pin 13 and 70 described above. Therefore, the use of molded seal rings prevents the rings from becoming loose, moving, becoming pinched or otherwise damaged during assembly, as is more likely if loose O-rings are utilized. However, the present invention is not limited to molded seal rings. Lubrication may be utilized prior to insertion of pin 13 into receptacle 70. Conceivably, the components could also be bonded by glue or the like but are preferably not bonded so that the connection can be broken if necessary. The lubrication material may also be selected for insulation properties.

Further in accordance with the present invention, a seating angle type seal with seating surface 46 (see FIG. 2) and corresponding mating seating surface in receptacle 70 may be utilized between insulator 12 and insulator 14. In one embodiment, the angle of the seating surfaces is the same such that the seal is effectively a wedge type seal over the entirety of these surfaces. In one embodiment, the seating surfaces may be at an angle of approximately 10 degrees to 40 degrees with respect to a centerline through pin 13. In one embodiment, the angle may be between 15 and 25 degrees, and as one example, may be 18 degrees. In another embodiment, the angle may be outside of these ranges or in another range, which is part of these ranges. In another embodiment, the angles between surface 46 and its mating surface may be somewhat different, perhaps by one or more degrees, perhaps less than 5 degrees to provide a point contact or circular ring contact seal.

In another possible embodiment of electrical connector 10, an inner face seal surface 48 (see FIG. 2) and corresponding surface may be present to provide yet another seal between insulators 12 and 14. While this surface is illustrated as being substantially flat, this surface may also be rounded or angled at a different angle than angled surface 46. The contact of these surfaces is made as screws 74 are tightened. Some additional length may be provided so that contact is made before faces 38 and 40 occurs to further compress/activate this seal, if desired.

A clearance 72 is provided between metal connectors could be possible after make-up of the connector in order to allow the rubber insulators at faces 38 and 40 to compress and establish appropriate sealing contact together, without contact of the electrical connectors preventing the sealing contact. As one possible example, a clearance of approximately 0.010 inches between metal connectors may exist after make-up of the connector.

FIG. 2A, shows an enlarged view of the outer face seal ring 36 which can be molded into first electrical insulator 12. The outer face seal ring 36 can aid in creating a seal between the respective insulators when assembled and thereby decreasing the incident of possible leaks in inclement weather or strong underwater currents.

Referring again to FIG. 2, an enlarged view of a possible configuration of first electrical insulator 12 is shown. As mentioned above, there can be seen a possible molded metal ring 34 inside of the pin section 12, which may serve as a support to assure rigidness and structural integrity of insulator 12. Metal ring may be positioned laterally or may be thicker to be directly against enlarged portion 66, or positioned elsewhere, and/or additional rings may be utilized if desired for further support of screw heads. The metal rings and fasteners provide high strength to hold connector 10 together even when underwater currents acting on the cables provide high forces which attempt to pull connector 10 apart.

The insulator of the present invention provides strong structural features and multiple seals in multiple flow paths to provide a subsea electrical connector that are reliable under circumstances that are likely to cause failure in prior art subsea connectors.

Accordingly, the foregoing disclosure and description of the invention is illustrative and explanatory thereof, and it will be appreciated by those skilled in the art, that various changes in the ordering of steps, ranges, materials, and/or attributes and parameters related to the materials, as well as in the details of the illustrations or combinations of features of the methods and apparatus discussed herein, may be made without departing from the spirit of the invention. Thus, while the invention has been described in connection with a preferred embodiment, it is not intended to limit the scope of the invention to the particular form set forth, but on the contrary, it is intended to cover such alternatives, modifications, and equivalents as may be included within the spirit and scope of the invention.

What is claimed is:

1. A subsea electrical connector for connecting a first cable and a second cable, comprising:

a first insulator, said first insulator comprising a first insulator outer face and a pin portion transverse to said first insulator outer face;

a second insulator comprising a second insulator outer face and a pin receptacle, said second insulator outer face mating to said first insulator outer face, said pin portion mating to said pin receptacle;

a face seal ring between said first insulator outer face and said second insulator outer face, said face seal ring being molded to one of said first insulator or said second insulator;

at least one pin seal ring between said pin portion and said pin receptacle, said at least one pin seal ring being molded to at least one of said first insulator or said second insulator;

an interference fit between said pin portion and said pin receptacle such that said pin portion comprises an outer diameter of said pin portion other than said at least one pin seal which is greater than an inner diameter of said pin receptacle other than said at least one pin seal prior to a make-up of said pin portion within said pin receptacle;

a seating angle seal comprising an angled surface on said pin portion and a corresponding angled surface within said pin receptacle;

first and second metal electrical connectors mounted within said first insulator and said second insulator, said first and second metal electrical connectors each comprising a socket for receiving said first and second cables;

molding around said first and second insulators operable to seal around said first cable and said second cable; and a plurality of fasteners for securing said first insulator to said second insulator, said plurality of fasteners extending through said first insulator outer face and said second insulator outer face.

2. A subsea electrical connector for connecting a first cable and a second cable, as claimed in claim 1 further comprising a pin end seal surface positioned at an end of said pin portion, and a mating seal surface in said pin receptacle, said angled surface on said pin portion being positioned between said pin end seal surface and said at least one pin seal ring.

3. A subsea electrical connector for connecting a first cable and a second cable, as claimed in claim 1 further comprising a face seal surface at an end of said pin, which mates to a corresponding seal surface within said pin receptacle, said seating angle surface on said pin portion being positioned between face seal surface and said at least one pin seal ring.

4. A subsea electrical connector for connecting a first cable and a second cable, as claimed in claim 1 further comprising a plurality of receptacles in said first insulator and said second insulator for said plurality of fasteners, and a plurality of stop members, which allow limited relative rotation to a selected rotational orientation between said first insulator and said second insulator, such that in said selected rotational orientation said plurality of receptacles in said first insulator and said second insulator are aligned.

5. A subsea electrical connector for connecting a first cable and a second cable, as claimed in claim 1 further comprising a plurality of receptacles in said first insulator and said second insulator for said plurality of fasteners, a metal ring mounted within at least one of said first insulator or said second insulator that defines a plurality of openings, which are aligned with said plurality of receptacles.

6. A subsea electrical connector for connecting a first cable and a second cable, as claimed in claim 1 further comprising a plurality of receptacles in said first insulator and said second insulator for said plurality of fasteners, and at least one guide member to align said plurality of receptacles in said first insulator and said second insulator.

7. A method for making a subsea electrical connector for connecting a first cable and a second cable comprising the steps of:

forming a first insulator comprising a first insulator outer face and a pin portion transverse to said first insulator outer face;

forming a second insulator comprising a second insulator outer face and a pin receptacle, said second insulator outer face mating to said first insulator outer face, said pin portion mating to said pin receptacle;

providing a molded face seal ring between said first insulator outer face and said second insulator outer face;

providing at least one molded pin seal ring between said pin portion and said pin receptacle;

providing a seating angle seal comprising an angled surface adjacent an end of said pin portion and a corresponding angled surface within said pin receptacle;

mounting first and second metal electrical connectors within said first insulator and said second insulator;

providing that said first and second metal electrical connectors each comprise a socket for receiving said first and second cables;

providing insulator end sockets in said first insulator and said second insulator for receiving said first and second cables;

providing a plurality of fasteners for securing said first insulator to said second insulator that extend through said first insulator outer face and said second insulator outer face; and molding said first and second insulators around said first and second cables for sealing around said insulator end sockets of said first and second insulators with respect to said first and second cables.

8. A method for making a subsea electrical connector for connecting a first cable and a second cable as claimed in claim 7 further comprising providing an interference fit between said pin portion and said pin receptacle whereby an outer diameter of said pin portion at a position other than at said at least one molded pin seal ring is greater than a corresponding inner diameter of said pin receptacle prior to make-up of said subsea electrical connector.

9. A method for making a subsea electrical connector for connecting a first cable and a second cable as claimed in claim 7 further comprising mounting at least one metal ring within at least one of said first insulator or said second insulator, said at least one metal ring defining a plurality of openings therein, said plurality of openings being positioned so as to be operable for receiving said plurality of fasteners.

10. A method for making a subsea electrical connector for connecting a first cable and a second cable as claimed in claim 7 further comprising providing a plurality of rotation stop members to limit relative rotation between said first insulator and said second insulator and to align said first insulator and said second insulator for securing said plurality of fasteners.

11. A method for making a subsea electrical connector for connecting a first cable and a second cable as claimed in claim 7 further comprising providing a pin end seal surface positioned at an end of said pin portion, and a mating seal surface in said pin receptacle, and providing that said angled surface on said pin portion is positioned between said pin end seal surface and said at least one pin seal ring.

12. A method for making a subsea electrical connector for connecting a first cable and a second cable as claimed in claim 7 further comprising providing a plurality of molded pin seal rings between said pin portion and said pin receptacle.

13. A method for making a subsea electrical connector for connecting a first cable and a second cable as claimed in claim 7 further comprising providing that said plurality of fasteners comprise a plurality of enlarged head portions, forming a plurality of pockets which are enlarged to receive said plurality of head portions with at least one of said first insulator or said second insulator, providing that said plurality of pockets are each sized to permit limited axial movement of a respective head portion.

14. A subsea electrical connector for connecting a first cable and a second cable, comprising:

a first insulator comprising a first insulator outer face and a pin portion transverse to said first insulator outer face;

a second insulator comprising a second insulator outer face and a pin receptacle, said second insulator outer face mating to said first insulator outer face, said pin portion mating to said pin receptacle;

a face seal ring between said first insulator outer face and said second insulator outer face;

first and second metal electrical connectors molded within said first insulator and said second insulator, said first and second metal electrical connectors each comprising a socket for receiving said first and second cables, said first and second metal electrical connectors being sized such that when said first insulator outer face engages said second insulator outer face then said first and second metal electrical connectors define a clearance therebetween to allow said first insulator outer face and said second insulator outer face to engage;

at least one pin seal ring between said pin portion and said pin receptacle, said at least one pin seal ring being molded to at least one of said first insulator or said second insulator;

a plurality of fasteners, said first insulator and said second insulator defining a plurality of receptacles for said plurality of fasteners, said plurality of receptacles extending through said first insulator outer face and said second insulator outer face.

15. A subsea electrical connector for connecting a first cable and a second cable, as claimed in claim 14 further comprising an interference fit between said pin portion and said pin receptacle such that said pin portion comprises an outer diameter greater than an inner diameter of said pin receptacle prior to a make-up of said pin portion within said pin receptacle.

16. A subsea electrical connector for connecting a first cable and a second cable as claimed in claim 14 further comprising at least one metal member positioned in at least one of said first insulator or said second insulator, said at least one metal member defining a plurality of openings which are aligned with said plurality of receptacles.

17. A subsea electrical connector for connecting a first cable and a second cable as claimed in claim 14 further comprising molding around said first and second insulators operable to seal around said first cable and said second cable.

18. A subsea electrical connector for connecting a first cable and a second cable, as claimed in claim 14 further comprising a seating angle seal comprising an angled surface on said pin portion and a mating angled surface within said pin receptacle.

19. A subsea electrical connector for connecting a first cable and a second cable, as claimed in claim 18 further comprising a pin end seal surface positioned at an end of said pin portion, and a mating seal surface in said pin receptacle, said angled surface on said pin portion being positioned between said pin end seal surface and said at least one pin seal ring.

* * * * *